US007771109B2

(12) United States Patent
Huang et al.

(10) Patent No.: US 7,771,109 B2
(45) Date of Patent: Aug. 10, 2010

(54) LAMP FOR LIGHT STRING

(75) Inventors: Shih-Chih Huang, Taipei (TW); Ping Yang, Guangdong (CN)

(73) Assignee: Jetmax Industrial Ltd. (TW)

( * ) Notice: Subject to any disclaimer, the term of this patent is extended or adjusted under 35 U.S.C. 154(b) by 230 days.

(21) Appl. No.: 12/231,472

(22) Filed: Sep. 3, 2008

(65) Prior Publication Data

US 2009/0010000 A1 Jan. 8, 2009

Related U.S. Application Data

(63) Continuation-in-part of application No. 11/703,483, filed on Feb. 7, 2007, now abandoned.

(51) Int. Cl.
*H01R 33/00* (2006.01)

(52) U.S. Cl. ..... 362/654; 362/249.01; 362/249.14; 362/640; 362/647; 362/652

(58) Field of Classification Search ..... 362/234, 362/249.01, 249.14–249.19, 253, 255, 640, 362/647, 652–654, 806; 439/188, 375, 513; 200/51.1, 51.12
See application file for complete search history.

(56) References Cited

U.S. PATENT DOCUMENTS 6,257,740 B1 7/2001 Gibboney, Jr.
2006/0274556 A1 12/2006 Massabki et al.

*Primary Examiner*—Sandra L O'Shea
*Assistant Examiner*—Meghan K Dunwiddie
(74) *Attorney, Agent, or Firm*—Jackson Walker, LLP

(57) ABSTRACT

A lamp for a light string has a socket, multiple electric cords, an insulating partition, a leaf spring and a bulb assembly. The electric cords are mounted in the socket and have electrodes. The insulating partition is mounted in the socket and has a cavity and at least one stopper formed in the cavity. The leaf spring is mounted in the insulating partition, is V shaped, is held in place by the stopper and protrudes through a top of the insulating partition to selectively and respectively contact the electrodes. The bulb assembly is removably plugged into the socket and has a separator. The separator pushes the leaf spring into the insulating partition to stop the leaf spring from contacting the electrodes. When the bulb assembly is removed from the socket, the leaf spring returns to an original shape by resilience to contact the electrodes.

12 Claims, 5 Drawing Sheets

LAMP FOR LIGHT STRING

CROSS REFERENCE

The present invention is a continuation-in-part of application Ser. No. 11/703,483 filed on Feb. 7, 2007 now abandoned.

BACKGROUND OF THE INVENTION

1. Field of the Invention

The present invention relates to a lamp, and more particularly to a lamp for a light string, wherein the lamp maintains an electrical connection when a bulb is removed.

2. Description of Related Art

Light strings having multiple lamps electrically connected in series and are popular during festival seasons such as Christmas day, New Year . . . etc. because all the lamps emit lights with the same illumination. One major drawback of the light string is that when a bulb in one of the lamps in the light string is removed, the other lamps in the same light string will not emit light.

One solution to overcome the above drawback is provided by U.S. patent application with Pub. No. 2006/0274556 (Massabki et al. hereinafter). With reference to FIG. 5, Massabki et al. disclosed a lamp comprising a light assembly (60), a socket (70), two electrodes (80) and a torsional spring (90). The light assembly (60) comprises a body (61), a bulb (62) and two extension members (63). The body (61) has a bottom. The bulb (62) is mounted in the body (61) and has two filaments (621) protruding oppositely from the body (61). The extension members (63) are formed separately on the bottom of the body (61). The socket (70) is cylindrical, corresponds to and receives the light assembly (60) and has a fulcrum (71). The electrodes (80) are mounted in the socket (70). The torsional spring (90) is mounted in the socket (70), is formed by winding an iron stick around the fulcrum (71) and has two arms (91). The arms (91) are selectively and respectively connected to the electrodes (80).

When the light assembly (60) is inserted in the socket (70), the extension members (63) will respectively force the arms (91) of the torsional spring (90) to be deformed away from contacting the electrodes (80), and the filaments (621) of the bulb (62) are respectively connected to the electrodes (80). When the light assembly (60) is removed, the torsional spring (90) will recover and be connected to the electrodes (80). Therefore, light emitted from the light string is maintained even when one bulb (62) is removed because the torsional spring (90) provides a bypass loop for a current flowing in the light string.

However, the torsional spring (90) is thin so it is easily deformed to lose resilience or broken. If the torsional spring (90) is fatigued, the arms (91) may not reconnect to the electrodes (80) when the light assembly (60) is removed or may remain in connected to the electrodes (80) when the light assembly (60) is inserted in the socket (70). If the connection ends (91) do not reconnect to the electrodes (80) when the light assembly (60) is removed, the light string with the conventional lamps will not emit light when the light assembly (60) in one of the lamps is removed. If the arms (91) remain connected to the electrodes (80) when the light assembly (60) is inserted in the socket (70), the bypass loop will be maintained and the light assembly (60) will not light and causing a short circuit. The torsional spring (90) will be heated up because the short circuit and may cause the lamp to burn out, or explode causing a fire hazard.

To overcome the shortcomings, the present invention provides a lamp with leaf spring to mitigate or obviate the aforementioned problems.

SUMMARY OF THE INVENTION

The main objective of the invention is to provide a lamp for light strings, wherein the lamp maintains an electrical connection when a bulb is removed.

The lamp in accordance with the present invention comprises a socket, multiple electric cords, an insulating partition, a leaf spring and a bulb assembly. The socket has an opening being formed through a top of the socket. The electric cords are mounted in the socket and protrude from a bottom of the socket, and each electric cord has an electrode. The insulating partition is mounted in the socket and has a cavity and at least one stopper. The cavity is formed through a top of the insulating partition. The stopper is formed in the cavity. The leaf spring is mounted in the insulating partition, is V shaped, is held in place by the stopper and protrudes through the top of the insulating partition to selectively and respectively contact the electrodes. The bulb assembly is removably plugged into the socket and has a separator and multiple wires. The separator is formed on a bottom of the bulb assembly and pushes the leaf spring into the insulating partition to stop the leaf spring from contacting the electrodes. The wires selectively and respectively contact the electrodes. When the bulb assembly is removed from the socket, the leaf spring returns to an original shape by resilience to contact the electrodes.

Other objectives, advantages and novel features of the invention will become more apparent from the following detailed description when taken in conjunction with the accompanying drawings.

DETAILED DESCRIPTION OF PREFERRED EMBODIMENT

Figure 1:
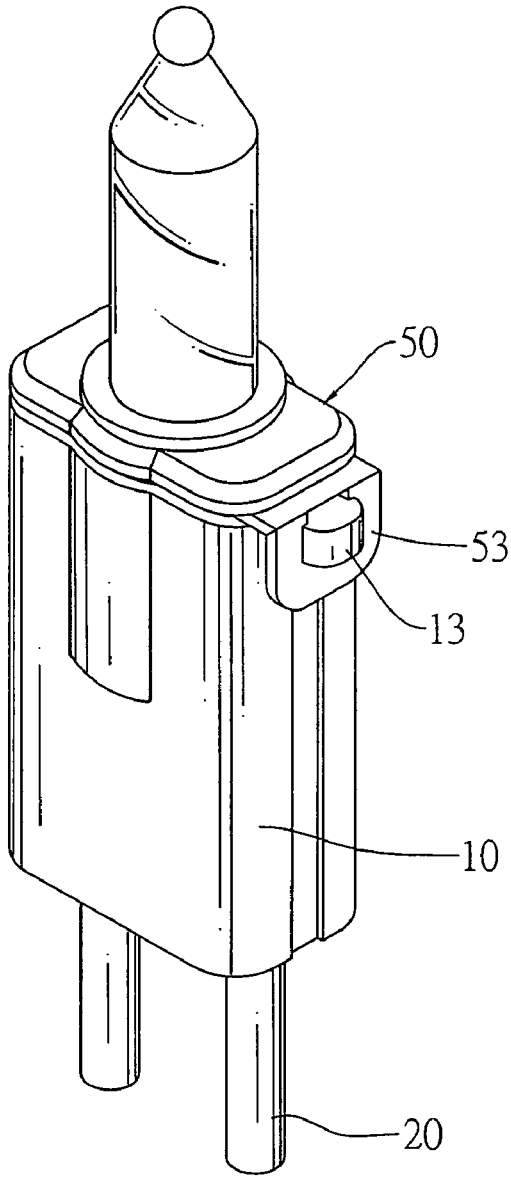
FIG. 1 is a perspective view of a lamp in accordance with the present invention.
Figure 2:
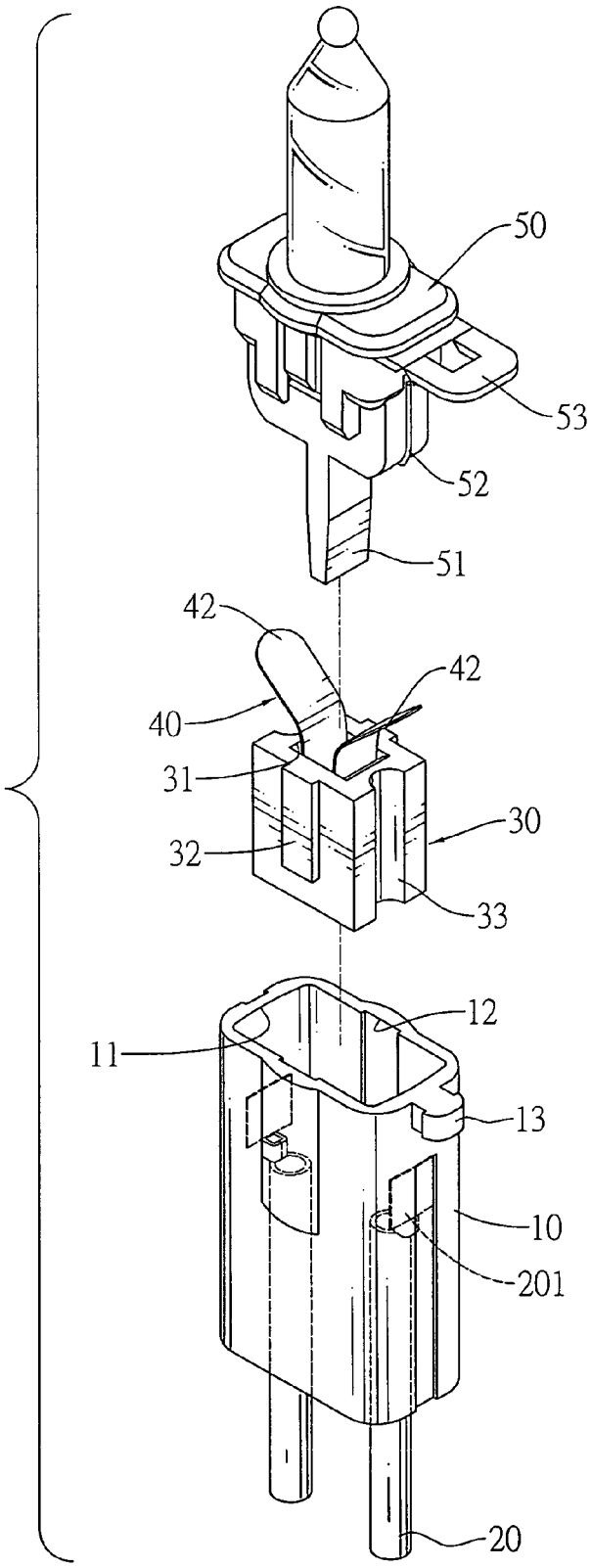
FIG. 2 is an exploded view of the lamp in FIG. 1.

With reference to FIGS. 1 and 2, a lamp for a light string in accordance with the present invention comprises a socket (10), multiple electric cords (20), an insulating partition (30), a leaf spring (40) and a bulb assembly (50).

The socket (10) is hollow, has a top, a bottom, an outer surface, an inner surface and an opening (11) and may further have multiple guide grooves (12) and a protrusion (13). The opening (11) is formed through the top of the socket (10) and may be rectangular to prevent fingers from entering the socket (10). The guide grooves (12) are formed oppositely on the inner surface of the socket (10). The protrusion (13) is formed perpendicularly on the outer surface of the socket (10) and is adjacent to the opening (11).

The electric cords (20) are mounted in the socket (10) and protrude from the bottom of the socket (10). Each electric cord (20) has a top and an electrode (201) mounted in the electric cord (20) and protruding through the top of the electric cord (20).

Figure 4:
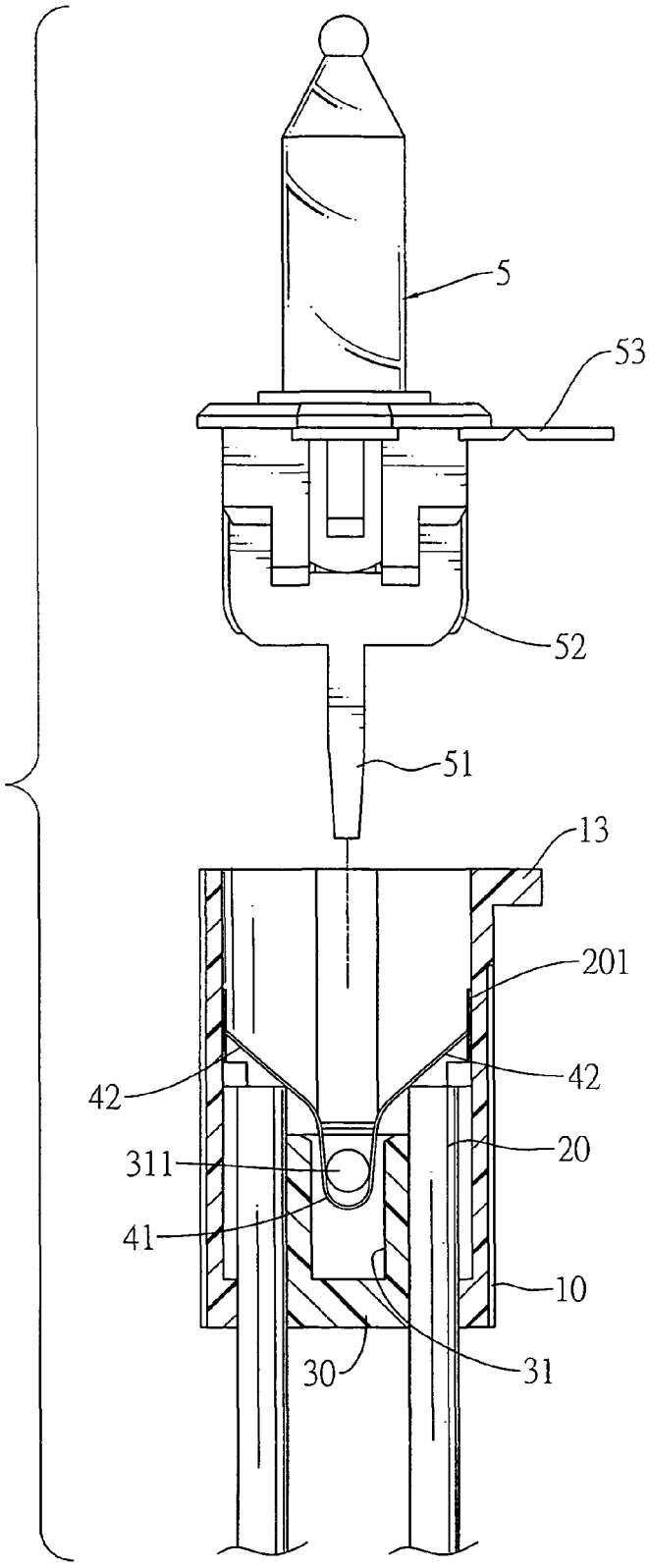
FIG. 4 is an exploded side view in partial section of the lamp with a bulb assembly removed from a socket.
Figure 5:
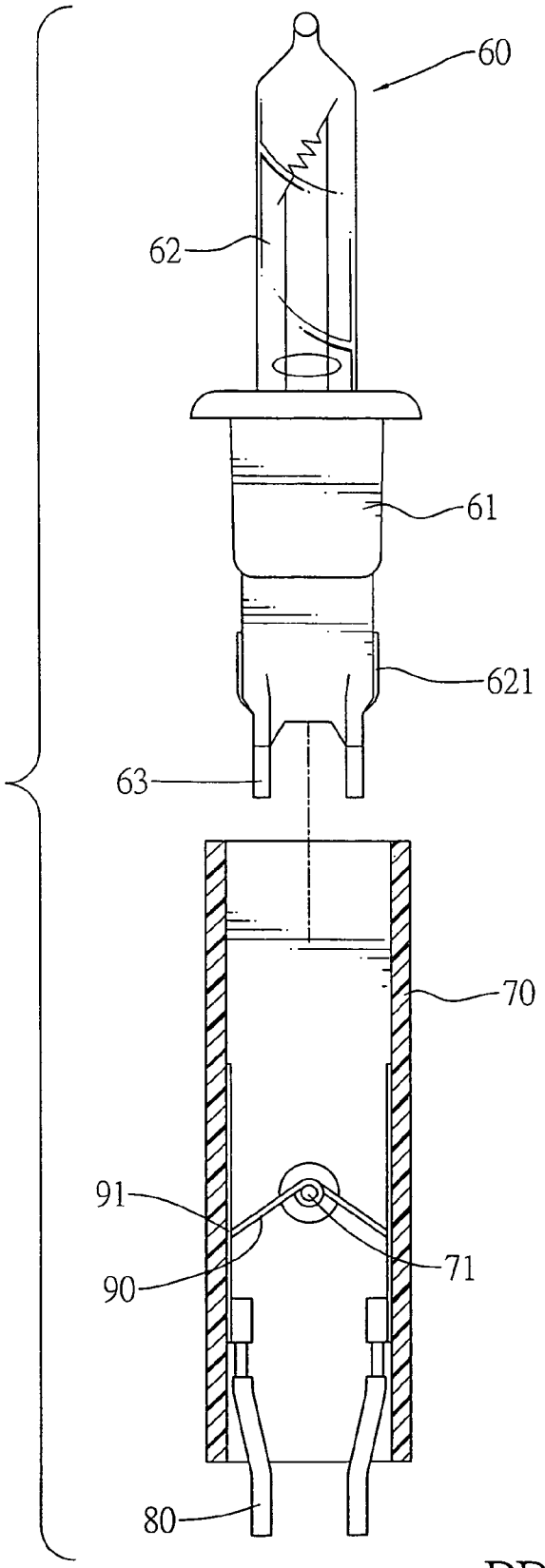
FIG.5 PRIOR ART
FIG. 5 is an exploded side view in partial section of a conventional lamp.

With further reference to FIG. 4, the insulating partition (30) is mounted in the socket (10) and has a top, an outer surface, a cavity (31), at least one stopper (311) and may further have multiple guide wings (32) and multiple cutouts (33). The cavity (31) is formed through the top of the insulating partition (30). The at least one stopper (311) is formed in the cavity (31). The guide wings (32) are formed oppositely on the outer surface of the insulating partition (30) and correspond respectively to and are mounted in the guide grooves (12) of the socket (10). The cutouts (33) are formed oppositely on the outer surface of the insulating partition (30) and correspond respectively to and secure the electric cords (20) in the socket (10).

The leaf spring (40) is conductive and resilient, may be made of steel, is mounted in the insulating partition (30), is substantially V shaped and has an apex (41) and two arms (42). A steel leaf spring (40) has better resilience to fatigue than a conventional torsional spring. The apex (41) is held in place by the stopper (311) so the leaf spring (40) is mounted movably in the insulating partition (30). The arms (42) protrude through the top of the insulating partition (30) and selectively and respectively contact the electrodes (201).

The bulb assembly (50) corresponds to and is removably plugged into the socket (10), protrudes from the opening (11) of the socket (10), has a bottom, an outer surface, a separator (51) and multiple wires (52) and may further have a tab (53).

Figure 3:
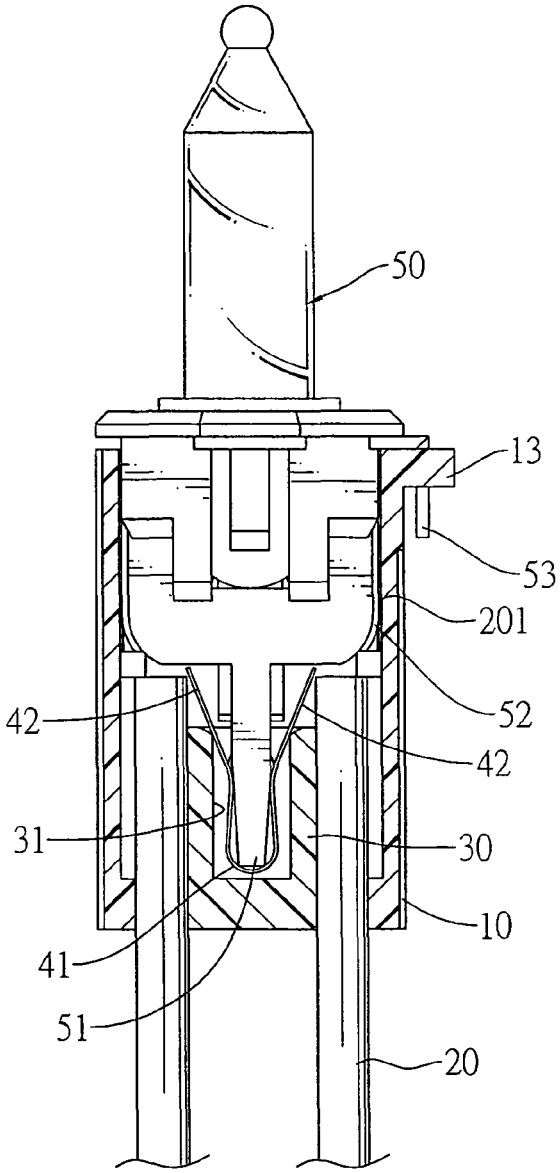
FIG. 3 is a side view in partial section of the lamp in FIG. 1.

With further reference to FIG. 3, the separator (51) is formed on the bottom of the bulb assembly (50), corresponds to and pushes the lower end (41) of the leaf spring (40) into the insulating partition (30). When the leaf spring (40) is pushed into the insulating partition (30), the leaf spring (40) will be deformed by the insulating partition (30) so the arms (42) break contact with the electrodes (201).

The wires (52) protrude oppositely through the outer surface of the bulb assembly (50), correspond to and respectively and selectively contact the electrodes (201). When the bulb assembly (50) is removed from the socket (10), the wires (52) no longer contact the electrodes (201).

The tab (53) is formed pivotally on the outer surface of the bulb assembly (50) and corresponds to the protrusion (13) on the socket (10). The tab (53) is selectively engages the protrusion (13) to ensure that the bulb assembly (50) is held in the socket (10) and not accidentally removed.

With such a lamp, even if the bulb assembly (50) is removed from the socket (10) accidentally or for maintenance, because the separator (51) no longer pushes the leaf spring (40), the leaf spring (40) will return to an original shape and the arms (42) will respectively contact the electrodes (201). Therefore, if the lamp of the present invention is used in a light string and the bulb assembly (50) of the lamp is removed from the socket (10), light emitted from the light string will still be maintained because the connection between the leaf spring (40) and the electrodes (201) creates a bypass loop for a current flowing in the light string. Furthermore, the leaf spring (40) is protected by the insulating partition (30) to prevent the leaf spring (40) from contacting to the electrodes (201) when the bulb assembly (50) is mounted in the socket (10).

Even though numerous characteristics and advantages of the present invention have been set forth in the foregoing description, together with details of the structure and function of the invention, the disclosure is illustrative only. Changes may be made in detail, especially in matters of shape, size, and arrangement of parts within the principles of the invention to the full extent indicated by the broad general meaning of the terms in which the appended claims are expressed.

What is claimed is:

1. A lamp for a light string comprising:

a socket being hollow and having a top, a bottom, an outer surface, an inner surface and an opening being formed through the top of the socket;

multiple electric cords being mounted in the socket and protruding from the bottom of the socket, and each electric cord having a top and an electrode mounted in the electric cord and protruding through the top of the electric cord;

an insulating partition being mounted in the socket and having a top;

an outer surface;

a cavity being formed through the top of the insulating partition; and at least one stopper being formed in the cavity;

a leaf spring being conductive and resilient, being mounted in the insulating partition, being V shaped and having an apex being held in place by the stopper so the leaf spring is mounted movably in the insulating partition; and two arms protruding through the top of the insulating partition and selectively and respectively contacting the electrodes; and a bulb assembly corresponding to and being removably plugged into the socket, protruding from the opening of the socket and having a bottom;

an outer surface;

a separator being formed on the bottom of the bulb assembly, corresponding to and pushing the lower end of the leaf spring into the insulating partition; and multiple wires protruding oppositely through the outer surface of the bulb assembly, corresponding to and selectively and respectively contacting the electrodes.

2. The lamp as claimed in claim 1, wherein the leaf spring returns to an original shape and the arms respectively contact the electrodes when the bulb assembly is removed from the socket.

3. The lamp as claimed in claim 1, wherein the opening of the socket is rectangular.

4. The lamp as claimed in claim 2, wherein the opening of the socket is rectangular.

5. The lamp as claimed in claim 1, wherein the leaf spring is made of steel.

6. The lamp as claimed in claim 2, wherein the leaf spring is made of steel.

7. The lamp as claimed in claim 1, wherein the insulating partition further has multiple cutouts being formed oppositely on the outer surface of the insulating partition and corresponding respectively to and securing the electric cords.

8. The lamp as claimed in claim 2, wherein the insulating partition further has multiple cutouts being formed oppositely on the outer surface of the insulating partition and corresponding respectively to and securing the electric cords.

9. The lamp as claimed in claim 1, wherein:

the socket further has a protrusion being formed perpendicularly on the outer surface of the socket and being adjacent to the opening; and the bulb assembly further has a tab being formed pivotally on the outer surface of the bulb assembly, corresponding to the protrusion on the socket and selectively engaging the protrusion.

10. The lamp as claimed in claim 2, wherein:

the socket further has a protrusion being formed perpendicularly on the outer surface of the socket and being adjacent to the opening; and the bulb assembly further has a tab being formed perpendicularly on the outer surface of the bulb assembly, corresponding to the protrusion on the socket and selectively engaging with protrusion.

11. The lamp as claimed in claim 1, wherein:

the socket further has multiple guide grooves being formed oppositely on the inner surface of the socket; and the insulating partition further has multiple guide wings being formed oppositely on the outer surface of the insulating partition and corresponding respectively to and being mounted in the guide grooves of the socket.

12. The lamp as claimed in claim 2, wherein:

the socket further has multiple guide grooves being formed oppositely on the inner surface of the socket; and the insulating partition further has multiple guide wings being formed oppositely on the outer surface of the insulating partition and corresponding respectively to and being mounted in the guide grooves of the socket.

* * * * *